United States Patent [19]

Vivier et al.

[11] 4,405,069

[45] Sep. 20, 1983

[54] AMPOULE BREAKER

[76] Inventors: Ghislain Vivier, P.O. Box 247, Val Therese, Ontario, Canada, P0M 3B0; Aurele Gauthier, 119 Vaillancourt Cr., P. O. Box 698, Chelmsford, Ontario, Canada, P0M 1L0

[21] Appl. No.: 254,180

[22] Filed: Apr. 14, 1981

[30] Foreign Application Priority Data

Oct. 30, 1980 [CA] Canada ..... 363640

[51] Int. Cl.[3] ..... B26F 3/00

[52] U.S. Cl. ..... 225/93; 241/99

[58] Field of Search ..... 225/93, 96.5, 103; 241/99; 81/3 R

[56] References Cited

U.S. PATENT DOCUMENTS

| | | | |
|---|---|---|---|
| 2,503,517 | 4/1950 | Sirica | 241/99 X |
| 3,552,083 | 1/1971 | Andersen et al. | 241/99 X |
| 3,796,359 | 3/1974 | Dick | 225/93 |
| 4,226,376 | 10/1980 | Pfleger | 225/93 X |

FOREIGN PATENT DOCUMENTS

| | | |
|---|---|---|
| 146594 | 3/1913 | Canada . |
| 440220 | 3/1947 | Canada . |
| 881260 | 9/1971 | Canada . |
| 1012803 | 6/1977 | Canada . |
| 1099960 | 4/1981 | Canada . |

*Primary Examiner*—Frank T. Yost

*Attorney, Agent, or Firm*—Fleit, Jacobson, Cohn & Price

[57] ABSTRACT

An ampoule breaker comprises a body member capable of being held in a person's hand and having a hollow end portion constructed of flexible, resilient material. The end portion has an open end adapted to receive an ampule head and is formed with slots extending axially from the open end. The slots permit the end portion to be compressed between a person's fingers so that an ampule head located in the end portion can be firmly held therein and broken off by manipulation of the breaker. The slots comprise two generally V-shaped slots located on diametrically opposite sides of the end portion with the narrow end of each slot being disposed away from the open end. At least the end portion is made of cut-resistant flexible plastic.

9 Claims, 6 Drawing Figures

AMPOULE BREAKER

BACKGROUND OF THE INVENTION

This invention relates to an ampoule breaker that can be used to remove the head from a glass ampoule containing a medication or other material which must be kept sterile or under an asceptic condition.

Medications of various sorts are often packaged in a glass container or ampoule. Since glass is substantially inert and non-absorptive, medication can be stored in such ampoules safely for long periods of time.

An ampoule is generally constructed with a main body portion containing the medication and a head portion which is separated from the body by a neck of reduced cross section. The individual removing the medication from the ampoule is expected to break off the head portion by applying a twisting or bending force to the head. Often when the head portion is broken off, a jagged, sharp edge remains on the body or head portion.

A problem faced by medical personnel when using these glass ampoules is that their fingers could be cut from the sharp jagged edge formed where the neck breaks. Also the ampoule head itself may break unexpectedly when a twisting force is applied to it in order to open the ampoule. This unexpected breaking apart of the head could be due to faults in the glass or rough handling of the ampoule from the time it leaves the factory to arrival at the hospital or clinic.

It is already known to provide a plastic hand tool to assist medical personnel in the removal of ampoule heads. One such hand tool is taught in Canadian Pat. No. 1,022,130 issued Dec. 6, 1977 to IMS Limited. The known tool has two oppositely facing cylindrical members each of which is open at its outer end. The closed ends of the members are joined and separated by an intervening web of material. The walls of each cylinder are inwardly elliptically digitally deformable and can recover to their original form upon release of the digital pressure. Each of the cylinders has a length adapted to receive the upper portion only of an ampoule and each has a diameter adapted to loosely receive this upper portion. The cylinders are of different sizes in order that the tool can be used to open medicine ampoules of two different standard sizes.

The disadvantage of the known hand tool for opening glass ampoules is that a single tool is only able to open ampoules of two predetermined sizes and any ampoules of a different size require a further, separate tool. Since glass ampoules are sold in many cifferent sizes, ranging for example from 1 mm to 50 mm, quite a number of the known hand tools would be required in order to provide means for opening all of these different ampoules.

A further problem with the known hand tools is that the person using it must first determine which end of the tool must be used to fit the particular ampoule to be opened since the size of the cylindrical ends may vary only slightly, the correct end to be used may not be readily apparent.

The ampoule breaker of the present invention provides a reliable tool that can be used quickly to open ampoules of different sizes. Moreover the ampoule breaker disclosed herein is of very simple construction and yet it provides ample protection for the fingers of a person breaking off the head of an ampoule.

SUMMARY OF THE INVENTION

It is an object of the present invention to provide an ampoule breaker which obviates and mitigates from the aforementioned disadvantages and difficulties of the prior art.

It is also an object of the present invention to provide an ampoule breaker which comprises a body member capable of being held in a persons hand, said member including a hollow end portion constructed of flexible resilient material and having an open end adapted to receive an ampoule head. The end portion is formed with slots extending axially from the open end. The slots comprise two generally V-shaped slots located on diametrically opposite sides of the end portion, the narrow end of each slot being disposed away from said open end. The slots permit the end to be compressed between the person's fingers so that an ampoule head located in the end portion can be firmly held therein and broken off by manipulation of the breaker.

BRIEF DESCRIPTION OF THE DRAWINGS

Other features and advantages will be apparent to those skilled in the art from the accompanying drawings and the following detailed description of preferred embodiments.

In the drawings.

DESCRIPTION OF PREFERRED EMBODIMENTS

Figure 1:
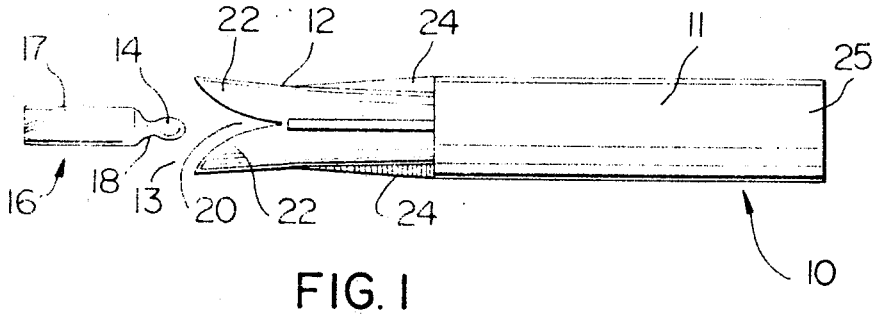
FIG. 1 is a side view of an ampoule breaker constructed in accordance with this invention.
Figure 2:
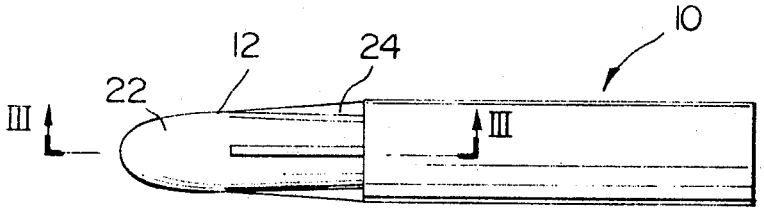
FIG. 2 is a top view of the ampoule breaker of FIG. 1.

The ampoule breaker 10 shown in FIGS. 1 and 2 comprises a body member 11 capable of being held in a person's hand. The member 11 has a hollow end portion 12 constructed of flexible, resilient material. The end portion 12 has an open end 13 adapted to receive an ampoule head 14. The ampoule 16 shown in FIG. 1 also has a main body 17 which contains liquid or powdered medicine or other substance requiring a sterile environment. The head portion 14 and body portion 17 are separated by a neck 18 of reduced cross section. The ampoule 16 is designed in such a way that one can by the simple application of a twisting or bending force to head 14 remove the head 14 and thus gain access to the medicine or other substance contained in the ampoule.

The end portion 12 is formed with two slots 20 extending axially from the open end 13. Preferably the slots are V-shaped with the narrow end of each slot being disposed away from the open end. The slots define or separate two flexible lip portions 22, each of which as can be seen from FIG. 2 is rounded so that there are no corners formed by the edge of the lip portion. Since the end portion is hollow, it will be appreciated that each lip portion forms part of a cylindrical surface both externally and internally. The slots 20 permit the end portion in the vicinity of the lip portions 22 to be compressed between a person's fingers so that an ampoule head located in the head portion can be firmly held therein and broken off by manipulation of the breaker 10. In practice the ampoule head would be placed directly between the lip portions 22.

The end portion 12 is preferably made from a cut-resistant flexible plastic. Suitable materials include high-density polyethylene or polypropylene. The thickness of the walls of the end portion is such that the walls are readily deformable by a person's fingers. Since only the lip portions 22 need to be quite flexible, the rest of the end portion can be reinforced by axially extending ribs 24 if desired. In the embodiment shown in FIGS. 1 and 2, there are only four such ribs provided. However the number of ribs could be as many as eight or more and the preferred embodiment shown in FIG. 6 has in fact eight such ribs. The ribs assist in maintaining the proper cylindrical shape of the end portion 12.

Figure 4:
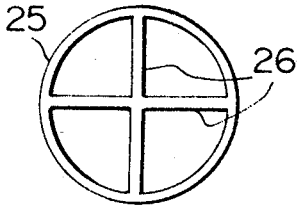
FIG. 4 is a right end view of the body of the breaker shown in FIG. 1.

The body member 11 has a cylindrical section 25 that can be readily and easily grasped in one hand. In the preferred embodiment this section would have a length of approximately 6.5 cm and a width of about 1.7 cm. The cylindrical section can be of either solid construction or hollow. If hollow, the interior of the section can be reinforced by means of diagonally extending supports 26 shown in FIG. 4. With the use of the supports 26 the section 25 can be made of inexpensive plastic material and yet the section will maintain the required cylindrical shape. If desired, the cylindrical section can also have a knurled surface such as that shown in FIG. 6. A knurled surface 28 helps the user to maintain a firm grip on the tool while it is being used to break off the head of an ampoule. Alternatively the surface 28 can be provided with a sandpaper-like texture.

Figure 5:
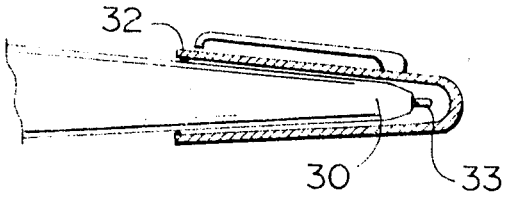
FIG. 5 shows an alternative body construction for the breaker wherein a pen is provided at one end.

If desired, the hand tool can be constructed to have a dual function. One end of the tool can be formed with an end portion 12 such as shown in FIG. 1 while the other end provides a pen 30 as shown in FIG. 5. The tool could be sold with a suitable pen cover 32 constructed in any well known manner. The pen 30 might take the form of a ballpoint pen having a tapered configuration in the region of the head 33 of the pen. Clearly, the end of the tool opposite the ampoulebreaker could also be designed for other purposes. For example the end could be provided with a bottle opener or a letter opener.

Figure 3:
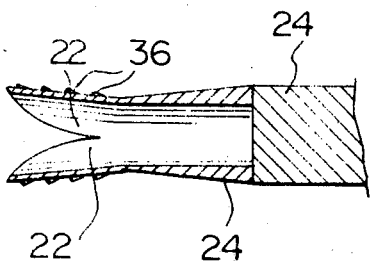
FIG. 3 is a sectional view taken along the line III—III shown in FIG. 2.
Figure 6:
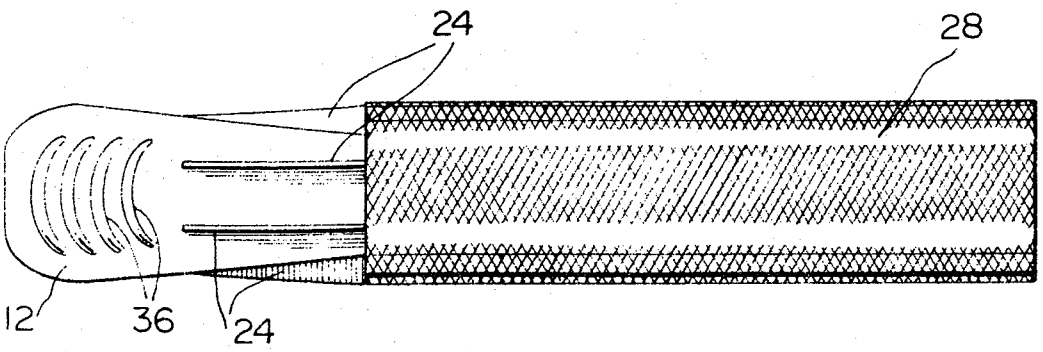
FIG. 6 is a top view of an ampoule breaker provided with certain preferred features.

In the preferred embodiment shown in FIG. 6, the end portion 12 is provided with protruding ridges 36 which can also be seen in FIG. 3. These ridges 36 provide means for the thumb and finger to readily maneuver the lip portions 22 while the lip portions are being used to break off the head of the ampoule. In the embodiment illustrated there are four of these ridges provided on each lip portion.

The ampoule breaker should be constructed of such a size that it will readily accommodate ampoules of various sizes that are on the market. One particularly preferred ampoule head that will accommodate ampoules ranging in size from 1 mm to 50 mm has an external diameter at the open end of about 1.6 cm and an internal diameter at the same end of about 1.4 cm. The external diameter of the end portion 12 tapeers to a diameter of 1.1 cm where the end portion 12 connects to the cylindrical section of the body member 11. The axial length of the hollow interior of the end portion 12 is about 4 cm while the axial length of the V-shaped slots is about 1.8 cm.

It will be appreciated by those skilled in the art that various modifications and changes can be made to the ampoule breaker as shown without varying from the broad concept of the invention. Accordingly, the above description should be viewed as illustrative of one or more forms of the invention and not as limiting.

We claim:

1. An ampoule breaker comprising a body member capable of being held in a person's hand, said member including a hollow end portion constructed of flexible, resilient material and having an open end adapted to receive an ampoule head, wherein said end portion is formed with slots extending axially from said open end, said slots comprising two generally V-shaped slots located on diametrically opposite sides of said end portion, the narrow end of each slot being disposed away from said open end to permit said end portion to be compressed between the person's fingers so that an ampoule located in said end portion can be firmly held therein and broken off by finger manipulation of said breaker.

2. An ampoule breaker according to claim 1 wherein the internal diameter of said end portion at the open end thereof, when in the uncompressed position thereof, substantially exceeds the diameter of said ampoule head.

3. An ampoule breaker according to claim 2 wherein at least said end portion is made of cut-resistant flexible plastic.

4. An ampoule breaker according to claim 1, 2, or 3 wherein said end portion is formed with reinforcing ribs on the exterior thereof, said ribs extending axially and being spaced apart from said open end.

5. An ampoule breaker according to claim 1, 2, or 3 wherein the internal diameter of said end portion at said open end is about 1.4 cm.

6. An ampoule breaker according to claim 1, 2, or 3 wherein the hollow interior of said end portion has a length of approximately 4 cm.

7. An ampoule breaker according to claim 1, 2, or 3, wherein the length of said slots in the axial direction is about 1.8 cm.

8. An ampoule breaker according to claim 1, 2, or 3 wherein said resilient material is high density polyethylene or polypropylene.

9. An ampoule breaker according to claim 1, 2, or 3 having a total length of approximately 10.5 cm and a width not exceeding 1.7 cm.

* * * * *